US006754464B2

(12) United States Patent
Mitsuya et al.

(10) Patent No.: US 6,754,464 B2
(45) Date of Patent: Jun. 22, 2004

(54) FULL-COLOR RECORDER USING POTENTIAL SPLIT DEVELOPING PROCESS

(75) Inventors: Teruaki Mitsuya, Hitachinaka (JP); Yasuo Kikuchi, Hitachinaka (JP); Akira Terakado, Hitachinaka (JP); Kazuo Sakaki, Hitachinaka (JP); Shinya Kobayashi, Hitachinaka (JP); Akira Arimoto, Kokubunji (JP)

(73) Assignee: Hitachi Koki Co., Ltd., Tokyo (JP)

( * ) Notice: Subject to any disclaimer, the term of this patent is extended or adjusted under 35 U.S.C. 154(b) by 8 days.

(21) Appl. No.: 10/123,415

(22) Filed: Apr. 17, 2002

(65) Prior Publication Data

US 2002/0150409 A1 Oct. 17, 2002

(30) Foreign Application Priority Data

Apr. 17, 2001 (JP) ..... 2001-118613

(51) Int. Cl.[7] ..... G03G 15/01
(52) U.S. Cl. ..... 399/223
(58) Field of Search ..... 399/223

(56) References Cited

U.S. PATENT DOCUMENTS 5,450,172 A * 9/1995 Suzuki et al. ..... 399/223
6,061,534 A * 5/2000 Okada et al. ..... 399/55 X
6,240,270 B1 * 5/2001 Mitsuya et al. ..... 399/223
6,292,645 B1 * 9/2001 Yu ..... 399/269 X

FOREIGN PATENT DOCUMENTS

JP 48-37148 * 6/1973
JP 11-184205 * 7/1999

OTHER PUBLICATIONS

IS&T Final Program and Proceedings (pp. 517–526) Oct. 30–Nov. 4, 1994.*

* cited by examiner

*Primary Examiner*—Fred L. Braun
(74) *Attorney, Agent, or Firm*—Antonelli, Terry, Stout & Kraus, LLP

(57) ABSTRACT

In order to provide a miniature full-color recorder having an excellent color reproducibility and to provide a full-color recorder having a wider color reproduction range beyond the range of subtraction color mixing of three primary colors, first and second potential split developing processes are continuously arranged for one recording medium.

9 Claims, 3 Drawing Sheets

FULL-COLOR RECORDER USING POTENTIAL SPLIT DEVELOPING PROCESS

BACKGROUND OF THE INVENTION

The present invention relates to an electrophotographic recorder such as a printer, facsimile, and copier for visualizing an image using colored particles such as toner and more particularly to a process of forming a full-color toner image on the surface of a recording medium.

A conventional developing method and developing machine will be explained hereunder. A recorder using the electrophotographic system is composed of a printing process for visualizing colored particles as an image on the surface of a recording medium and a fixing process for fixing the visualized colored particle image onto the recording medium. For colored particles, powder called toner used only for electrophotograpy is used. A photoconductor is charged overall the surface thereof once and then by irradiating light, the surface is partially discharged. In this case, on the surface of the photoconductor, a potential contrast due to the charging region and discharging region is formed and this is called an electrostatic latent image. In the developing process, firstly toner particles which are colored particles are charged. Toner particles are conveyed to the developing position opposite to the electrostatic latent image on the surface of the photoconductor by a roller called a developing roller. As a developing method for an electrostatic latent image, a method called bias development is often used. In the bias development, the bias voltage is applied to the developing roller and by the operation of the electric field generated between the latent image potential formed on the surface of the photoconductor and the developing roller, charged particles are separated from the surface of the developing roller, moved to the surface of the photoconductor, and imaged. As a latent image potential (namely, potential of the image formed portion of the photoconductor), the aforementioned charging potential or discharging potential may be used. Generally, a method for using the charging potential as a latent image potential is called a normal developing method and a method for using the discharging potential is called a reversal developing method. The potential among the charging potential and discharging potential which is not used as a latent image potential is called a background potential. The bias voltage of the developing roller is set between the charging potential and the discharging potential and the difference from the latent image potential is called a developing potential difference. In the same way, the difference from the background potential is called a background potential difference.

As a developed form of the printing process using the aforementioned bias development, there is a recording method available that the bias development is executed using primary color toner, and the primary color toner is transferred onto a recording medium such as a recording paper or an intermediate transfer medium, and this process is repeated sequentially on one recording medium for each primary color, thus a full-color image having a medium color is obtained. This method is called a tandem color process. To superimpose toners and represent a mediate color, subtraction color mixing using three primary colors of cyan (C), magenta (M), and yellow (Y) is used. Black (K) conspicuous in unequal color tone at the time of color mixing is often added as a primary color to form four primary colors. To use addition color mixing for requiring no superimposition of the same primary colors and representing a medium color by putting them side by side is possible in principle. However, in a case of a toner image by the electrophotographic method, the light source must depend on reflection of extraneous light, so that when addition color mixing is used, the saturation is reduced, and the color reproduction range is made extremely small, thus the addition color mixing method cannot be put into practical use. Therefore, in the tandem color process, the positioning accuracy between the primary colors is a very important factor for medium color reproduction by the subtraction color mixing method. Generally, it is desired that the displacement between the pixels of each primary color of C, M, and Y on the final recording medium, that is, the output image is 40 microns or less between any two pixels. However, practically, such accurate positioning (color superimposition) is technically difficult considerably and even in this case, it is said that the displacement must be 100 microns or less. By this method, only one color can be developed for one photoconductor device and to reproduce a medium color using the three primary colors and black, four independent printing processes are necessary for each primary color, so that a problem arises that the recorder is apt to be made larger.

Further, to reproduce a medium color using the three primary colors, two times of positioning is required and a problem also arises that the color superimposition accuracy between the primary colors cannot be increased easily.

Furthermore, when a primary color other than the primary colors C, M, and Y is added to reproduce a medium color, it results in enlargement of the recorder as it is, so that a problem arises that the color reproduction range is limited to the range obtained by subtraction color mixing of the three primary colors and becomes narrower.

As the aforementioned tandem color process, for example, the methods described in Lucien A. De Schamphelaere and Xeikon Team, "Digital Color Presses Applications and Technologies", IS&T's 10th International Congress Proceedings, pp. 517–526 (1994) and ISBN: 0-89208-179-1 are known.

SUMMARY OF THE INVENTION

In the aforementioned conventional full-color recorder, an independent printing process is necessary for each primary color, so that there are problems imposed that the recorder is apt to be made larger and the color superimposition accuracy between the primary colors cannot be easily improved. Furthermore, a problem arises that the color reproduction range is limited to the range of subtraction color mixing of the three primary colors and becomes narrower.

Therefore, an object of the present invention is to provide a full-color recorder excellent in color reproducibility because it is miniature and color superimposition accuracy can be obtained easily. Furthermore, another object of the present invention is to provide a full-color recorder having a wider color reproduction range beyond the range of subtraction color mixing of the three primary colors.

The above objects can be accomplished by using two potential split developing processes.

Next, the potential split developing processes will be explained. As a deformation example of the electrophotographic bias developing method, for example, as seen in Japanese Application Patent Laid-Open Publication No. Sho 48-37148 for long, there is a developing method that the potential of the charging region and discharging region of the photoconductor is divided into two parts and an intermediate potential region is provided, and a first developing unit for executing normal development is installed in the discharging region and develops the first toner, and then a second developing unit for executing reversal development is installed in the charging region and develops the second toner, thus two kinds of toners are developed in one charging process and light irradiation process (exposure process). By this developing method, toner is not developed on the intermediate potential region (called intermediate potential) on the photoconductor having a voltage between the bias voltage of the first normal developing unit and the bias voltage of the second reversal developing unit and the background portion is formed as an image, so that an image by two kinds of toners composed of the background portion, first image portion, and second image portion can be formed. The developing method is called a potential split developing process. In the potential split developing process, two kinds of toners are generally used for each color and used for the purpose of obtaining an image composed of two colors. The background portion, first image portion, and second image portion are divided into regions depending on the potential level of the surface of the photoconductor. Therefore, these regions are formed without being superimposed. This indicates that the two kinds of toners are not mixed. By this method, a different color tone is not generated by mixing two kinds of toners, so that for the color tone, the color itself appearing in an image is used. By this method, for one photoconductor device, a two-color image can be recorded at a time, so that there is an advantage that the recorder can be made compact. Further, although two toners cannot be mixed, at a predetermined position between two-color images, an electrostatic latent image is formed by one exposure process, so that there is also an advantage that it is not displaced in principle. Even if the first development is set to the reversal development and the second development is set to normal development, the potential split development is enabled.

To realize a full-color recorder using the potential split developing process, in one recording medium, the first and second potential split developing processes are continuously arranged. For the first potential split developing process, two primary colors for subtraction color mixing are used and for one color of the subsequent second potential split developing process, the residual primary color is used. In this state, the two primary colors used in the first potential split developing process cannot be mixed, so that the developing color tone of the residual one color of the second potential split developing process is decided so as to compensate for mixing of the two primary colors. Concretely, when either of the two primary colors used for the first potential split developing process is used, the three primary colors can be mixed. Further, when a color other than those is used, the color reproduction range may be enlarged. Interchanging the first and second potential split developing processes or interchanging the first color development and second color development of the same potential split developing process does not adversely affect the color reproducibility, so that the effect of the present invention can be obtained in the same way.

By the aforementioned method, a medium color can be reproduced by two printing processes, so that compared with the conventional tandem color process, a miniature full-color recorder can be realized. Further, one positioning is sufficient to execute, so that the color superimposition accuracy among the primary colors can be improved easily. Furthermore, for the color tone of one of the first and second potential split developing processes for compensating for color mixing, a color other than the three primary colors may be used, so that a wider color reproduction range beyond the range of subtraction color mixing of the three primary colors can be realized.

DETAILED DESCRIPTION OF THE PREFERRED EMBODIMENT

An embodiment of the present invention will be explained hereunder by referring to FIGS. 1 to 4.

Figure 1:
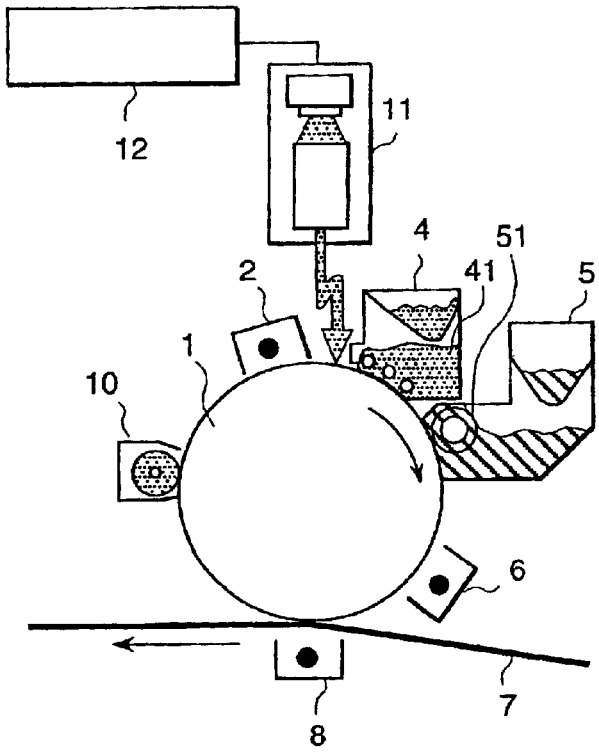
FIG. 1 is a cross sectional side view of one printing process of the potential split developing process.

FIG. 1 is a cross sectional side view of one printing process of the potential split developing process. Numeral 1 indicates a photosensitive drum, 2 a charger, 4 a first developing unit, 5 a second developing unit, 6 a pre-transfer charger, 7 a recording medium, 8 a transfer unit, 10 a cleaner, 11 an exposure unit, and 12 an exposure control means. On the surface of the photosensitive drum 1 uniformly charged by the charger 2, by a semiconductor laser controlled in light emission by the exposure control means 12 composed of a laser driver and the exposure unit 11 composed of an optical system, an electrostatic latent image is formed. Thereafter, by the two developing units 4 and 5, the electrostatic latent image is developed by two color toners by potential split development. The pre-transfer charger 6, since the two color toners to be developed are different in charging polarity from each other, is used so as to set them to the same polarity. The two color toners set to the same polarity by the pre-transfer charger 6 are transferred onto the recording medium 7 by the transfer unit 8. The toner remaining on the surface of the photosensitive drum 1 without being transferred is collected by the cleaner 10 and one printing process is finished.

Figure 2:
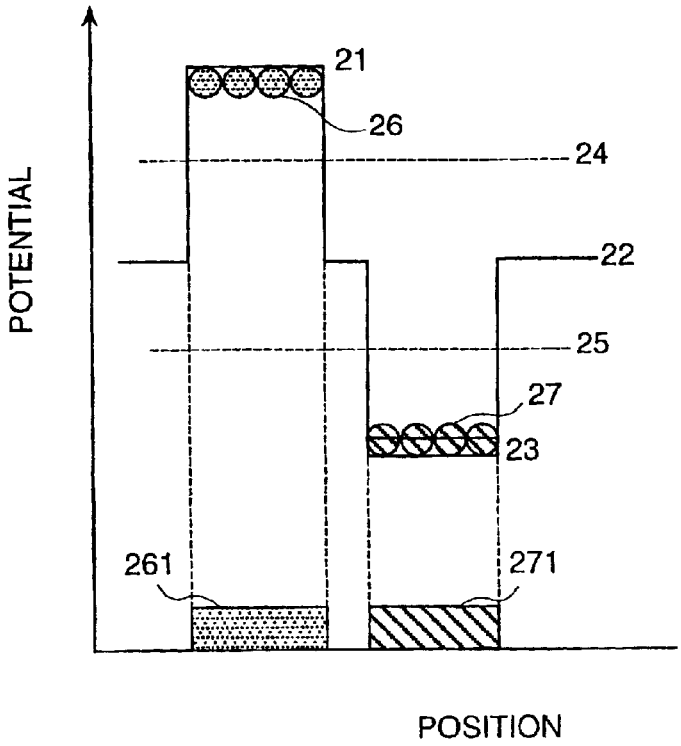
FIG. 2 is a drawing showing the relation between potential distribution and image arrangement of potential split development.

FIG. 2 is a drawing showing the relation between potential distribution and image arrangement of potential split development. Numeral 21 indicates charged potential (Vo), 22 intermediate potential (Vw), 23 discharged potential (Vr), 24 bias potential of the first developing unit, 25 bias potential of the second developing unit, 26 positive charged toner, 261 a positive charged toner image, 27 negative charged toner, and 271 a negative charged toner image. The potential split developing method is a developing method that the potential of the charging region 21 and the discharging region 23 of the photoconductor 1 is divided into two parts and the intermediate potential region 22 is provided, and the first developing unit 4 for executing normal development is installed in the discharging region 23 and develops the first toner 26, and then the second developing unit 5 for executing reversal development is installed in the charging region 21 and develops the second toner 27, thus two kinds of toners are developed in one charging process and light irradiation process (exposure process). By this developing method, toner is not developed on the intermediate potential region 22 (intermediate potential) on the photoconductor 1 having a voltage between the bias voltage 24 of the first normal developing unit 4 and the bias voltage 25 of the second reversal developing unit 5 and the background portion is formed as an image, so that an image by two kinds of toners composed of the background portion, first image portion, and second image portion can be formed. In the potential split developing process, two kinds of toners are generally used for each color and used for the purpose of obtaining an image composed of two colors. Even if the first development is set to the reversal development and the second development is set to normal development, the potential split development is enabled.

Figure 3:
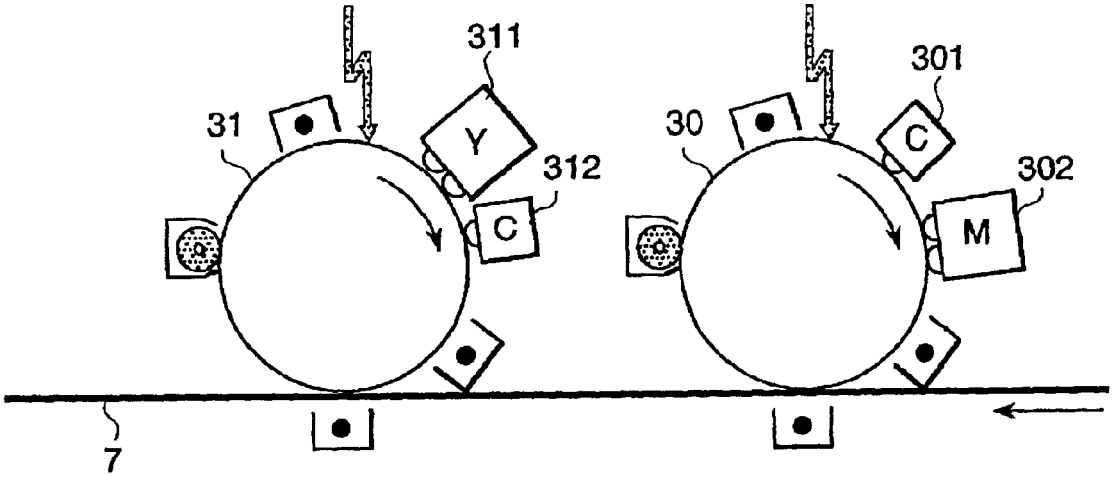
FIG. 3 is a schematic process diagram of a full-color printer which is an embodiment of the present invention.
Figure 4:
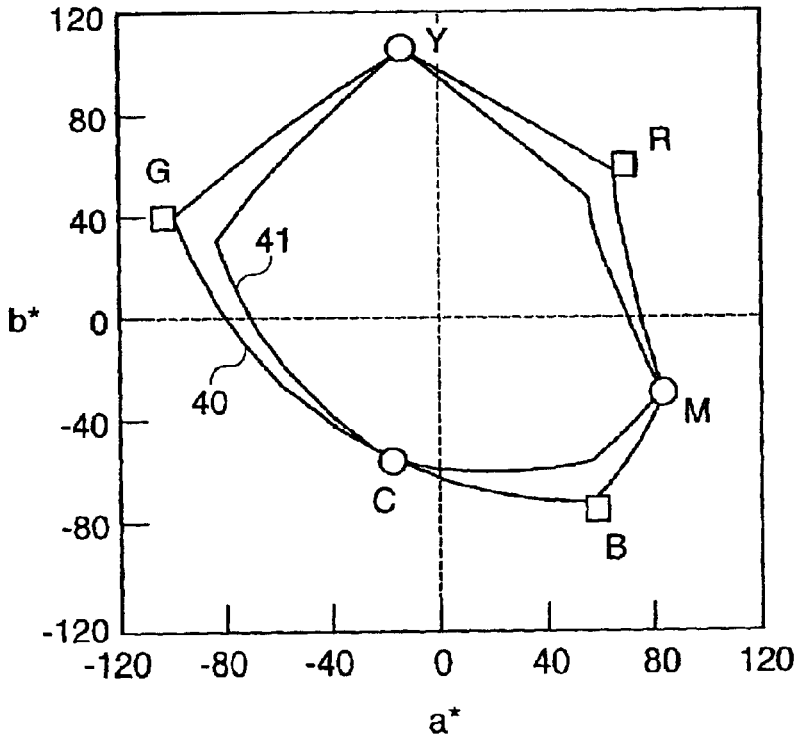
FIG. 4 is a drawing showing the reproduction range in the CIEL a* and b* color space of a full-color printer which is another embodiment of the present invention.

FIG. 3 is a schematic process diagram of the full-color printer of this embodiment. Numeral 30 indicates a first potential split developing process, 301 first color development of the first potential split developing process, 302 second color development of the first potential split developing process, 31 a second potential split developing process, 311 first color development of the second potential split developing process, and 312 second color development of the second potential split developing process. For the toner of the first development 301 of the first potential split developing process, the toner of the second color development 302 of the first potential split developing process, and the toner of the first color development 311 of the second potential split developing process, the primary colors of cyan (C), magenta (M), and yellow (Y) for subtraction color mixing are respectively used. Further, for the color tone of the toner of the second color development 312 of the second potential split developing process, cyan (C) is used. The toner of the second color development 312 of the second potential split developing process and the toner for the first development 301 of the first potential split developing process are exactly the same. In the processes of this embodiment, cyan (C) toner is shared and used by two printing processes, so that the developing unit for developing cyan (C) toner in each printing process is miniaturized. In this case, miniaturization is realized by reducing the capacity of a developer of one developing unit. The developer, in a case of two-component development, is a mixture of toner and carrier particles and in a case of one-component development, is toner itself. In the first potential split developing process 30, from the principle of the aforementioned potential split developing process, a mixture of C and M cannot be generated, though by use of the second color development 312 of the second potential split developing process, it is enabled. The color reproduction range of the process of this embodiment is shown in FIG. 4. FIG. 4 shows the reproduction range in the CIEL a* and b* color space. Numeral 40 indicates a color reproduction range of the full-color printer of this embodiment and 41 indicates a color reproduction range of the conventional tandem color process. In the full-color printer of this embodiment, particularly reproduction is executed by color superimposition mainly using red (R), blue (B), and green (G), so that wider color reproducibility than the conventional one can be obtained.

In the aforementioned full-color printer of this embodiment, only two printing processes are sufficient, so that a full-color recorder smaller than that of the conventional tandem color process can be realized. Further, the conventional tandem color process requires three printing processes, while in the full-color printer of this embodiment, colors can be superimposed by positioning between the two printing processes, so that the color superimposition accuracy between the primary colors can be improved and the color reproducibility can be enhanced more. Furthermore, among the printing processes, the developing unit for developing C toner can be miniaturized, so that the full-color recorder of this embodiment can be miniaturized more exceeding the effect generated from only two printing processes.

Figure 5:
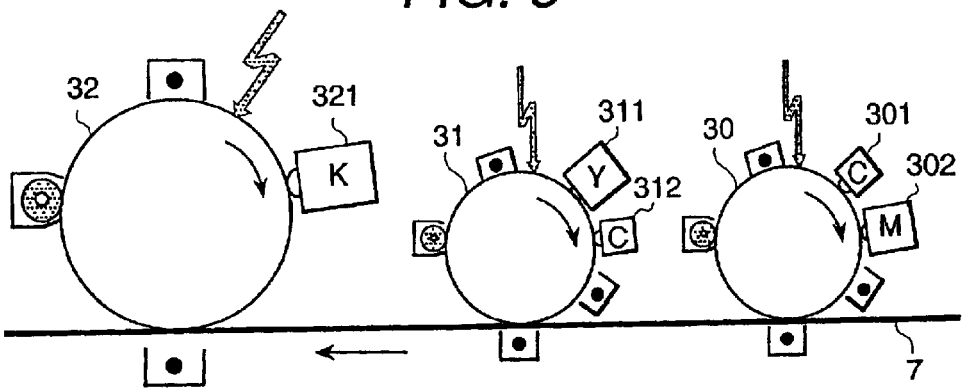
FIG. 5 is a schematic process diagram of a full-color printer which is another embodiment of the present invention.

Another embodiment of the present invention will be explained hereunder by referring to FIG. 5. FIG. 5 is a schematic process diagram of the full-color printer of this embodiment. Numeral 32 indicates a third developing process. The third developing process 32 is an ordinary monochromatic bias developing process only for black toner and uses no potential split development. The full-color printer of this embodiment is a printer that a printing process of only a black color is added to the embodiment shown in FIG. 3 by the third developing process 32. However, the first potential split developing process 30 and second potential split developing process 31 of this embodiment are made smaller than those shown in FIG. 3. Further, compared with the capacity of black developer, the developer capacities of the other developing units are set smaller. As one reason for independence of black, it may be cited that in the embodiment shown in FIG. 3 for producing black by subtraction color mixing, fine ununiformity of the color tone of black is apt to be conspicuous, so that black is used as a primary color. Independence of black is often used in the conventional tandem color process, though in this embodiment for producing a primary color by potential split development, it has a particular meaning different from the conventional one. The potential split development divides the charged potential into two parts, so that the developing potential difference per each color is reduced, thus the developing force per each color is low. To solve this problem, devises are made including an increase in the number of developing rolls so as to withstand printing for many hours at a high-density printing rate. In the actual printing mode, the consumption of black toner is overwhelmingly high, so that when black is made independent like this embodiment, the burdens on the first and second potential split developing processes 30 and 31 can be lightened greatly and the respective printing processes can be miniaturized.

According to this embodiment mentioned above, the development of black is made independent, so that a stable color tone of black is obtained, and the burden on the potential split developing process can be lightened, thus the respective printing processes can be miniaturized, and as a result, compared with the conventional tandem color process for four primary colors, a miniature full-color recorder can be realized.

Figure 6:
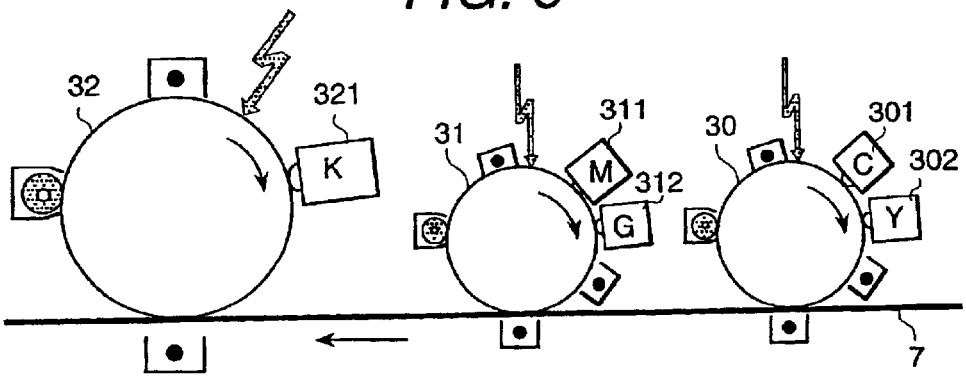
FIG. 6 is a schematic process diagram of a full-color printer which is still another embodiment of the present invention.
Figure 7:
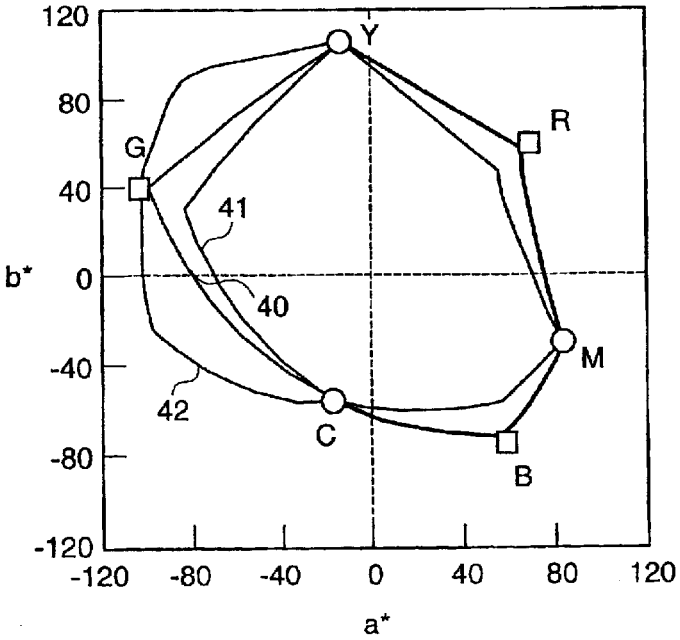
FIG. 7 is a drawing showing the reproduction range in the CIEL a* and b* color space of a full-color printer which is still another embodiment of the present invention.

Still another embodiment of the present invention will be explained hereunder by referring to FIGS. 6 and 7. FIG. 6 is a schematic process diagram of the full-color printer of this embodiment. The arrangement of the printing processes and numerals are the same as those shown in FIG. 5, though the color arrangement of each process of the potential split development is different. For the toner of the first development 301 of the first potential split developing process, the toner of the second color development 302 of the first potential split developing process, and the toner of the first color development 311 of the second potential split developing process, the primary colors of cyan (C), yellow (Y), and magenta (M) for subtraction color mixing are respectively used. Further, for the toner of the second color development 312 of the second potential split developing process, green (G) having a color tone to be generally used for addition color mixing is used. In this embodiment, C toner and Y toner of the first potential split developing process 30 cannot be mixed, though each toner is mixed with G toner of the second potential split developing process 31. By doing this, the color reproduction range can be expanded greatly. The color reproduction range of the process of this embodiment is shown in FIG. 7. FIG. 7 shows the reproduction range in the CIEL a* and b* color space in the same way as with FIG. 4. Numeral 40 indicates a color reproduction range of the full-color printer of Embodiments 1 and 2, 41 a color reproduction range of the conventional tandem color process, and 42 a color reproduction range of the full-color printer of this embodiment. The color spaces between "C and G" and "Y and G" are expanded greatly and an unconventionally very wide color reproduction range can be realized. Moreover, only two printing processes for controlling the medium color may be used in the same way as with Embodiments 1 and 2, and the miniaturization of the full-color recorder and color superimposition accuracy between the primary colors are never adversely affected, and the high performance realized in Embodiments 1 and 2 is taken over as it is.

Each color arrangement of potential split development of this embodiment is decided so as to take a wider color space to be covered. Namely, in the first potential split developing process 30, C toner and Y toner at a farthest distance in the color space are arranged. Moreover, from the viewpoint of the relation with G entering between them, "G and C" and "G and Y" are respectively farther away from each other and setting the second color development 312 of the second potential split developing process to G in addition to the color arrangement of the first potential split developing process 30 is most effective.

According to this embodiment mentioned above, a small full-color recorder can realize high color superimposition accuracy between the primary colors and an unconventional very wide color reproduction range can be realized. In this embodiment, C toner and Y toner are arranged in the first potential split developing process and G is used as a color to be mixed with them. However, even if C toner and Y toner are arranged in the second potential split developing process and G is used as a color to be mixed with them in the second potential split developing process, the same effect is obtained. Further, by color arrangement other than this combination, the effect of the present invention can be realized though the degree of effect may be different.

According to the present invention mentioned above, the first and second potential split developing processes are continuously arranged for one recording medium, and two primary colors for subtraction color mixing are used for the first potential split developing process, and the residual primary color is used for one color of the subsequent second potential split developing process, and the color tone of one residual development of the second potential split developing process is decided so as to compensate for mixing the two primary colors used in the first potential split developing process, so that the medium color can be reproduced by the two printing processes. Therefore, compared with the conventional tandem color process, a small full-color recorder can be realized, and one positioning is sufficient, so that there is an effect produced that the color superimposition accuracy between the primary colors can be improved. Furthermore, a color other than the three primary colors can be used for the color tone of one of the first and second potential split developing processes compensating for color mixing, so that there is an effect produced that a wider color reproduction range beyond the range of subtraction color mixing of the three primary colors can be realized.

What is claimed is:

1. A full-color recorder comprising:

a first potential split developing means having a first photoconductor, a first charger for charging a surface of said first photoconductor, a first exposure unit for forming image regions having potential levels of at least three different values including a first potential level, a second potential level being different from said first potential level and an intermediate potential level set between said first potential level and said second potential level on said first photoconductor by irradiating a light, a first developing unit for supplying a toner to said image region having said first potential level so as to form a toner image thereon, and a second developing unit for supplying a toner being different from said toner supplied to said image region having said first potential level to said image region having said second potential level so as to form a toner image thereon, wherein at least two kinds of toner images are formed on said first photoconductor; and a second potential split developing means having a second photoconductor, a second charger for charging a surface of said second photoconductor, a second exposure unit for forming image regions having potential levels of at least three different values including a first potential level, a second potential level being different from said first potential level and an intermediate potential level set between said first potential level and said second potential level on said second photoconductor by irradiating a light, a first developing unit for supplying a toner to said image region having said first potential level so as to form a toner image thereon, and a second developing unit for supplying a toner being different from said toner supplied to said image region having said first potential level to said image region having said second potential level so as to form a toner image thereon, wherein at least two kinds of toner images are formed on said second photoconductor;

wherein said first potential split developing means and said second potential split developing means are arranged in series, two kinds of toners among toners of three primary colors of cyan, magenta and yellow are used in said first developing unit and said second developing unit provided in said first potential split developing means, and two kinds of toners among toners of said three primary colors including one toner which is not used in said first potential split developing means are used in said first developing unit and said second developing unit provided in said second potential split developing means.

2. A full-color recorder according to claim 1, wherein developer capacities of said first and second developing units for developing each colored toner once respectively among said toners of cyan, magenta, and yellow by said first potential split developing means and said second potential split developing means are made smaller than developer capacities of other developing units.

3. A full-color recorder according to claim 2, wherein four kinds of toners are used and for three kinds of toners among said four kinds of toners, toners of said three primary colors of cyan, magenta, and yellow are used and for one residual kind of toner, a toner of any one color tone of red, green, and blue is used.

4. A full-color recorder according to claim 1, wherein four kinds of toners are used for said first potential split developing means and said second potential split developing means and for three kinds among said four kinds of toners, toners of said three primary colors of cyan, magenta, and yellow are used.

5. A full-color recorder according to claim 4, wherein for one of said first potential split developing means and said second potential split developing means, a combination of cyan and yellow toners is used and for other potential split developing means, a combination of magenta and green toners is used.

6. A full-color recorder according to claim 1, further comprising said first potential split developing means, said second potential split developing means, and a third developing means.

7. A full-color recorder according to claim 6, wherein said third developing means develops one color.

8. A full-color recorder according to claim 7, wherein a developer capacity of a developing unit used in said third developing means is larger than developer capacities of said developing units used in said first potential split developing means and said second potential split developing means.

9. A full-color recorder according to claim 1, wherein a third developing means using only black toner is installed independently of said first potential split developing means and said second potential split developing means.

* * * * *